US007636978B2

(12) United States Patent
Blokpoel

(10) Patent No.: US 7,636,978 B2
(45) Date of Patent: Dec. 29, 2009

(54) POLISHING IMPLEMENT FOR POLISHING SHOES

(75) Inventor: Willem Peter Blokpoel, Schagen (NL)

(73) Assignee: Sara Lee/DE N.V., Utrecht (NL)

( * ) Notice: Subject to any disclaimer, the term of this patent is extended or adjusted under 35 U.S.C. 154(b) by 336 days.

(21) Appl. No.: 10/564,730

(22) PCT Filed: Jul. 13, 2004

(86) PCT No.: PCT/NL2004/000508

§ 371 (c)(1),
(2), (4) Date: Jun. 22, 2006

(87) PCT Pub. No.: WO2005/006937

PCT Pub. Date: Jan. 27, 2005

(65) Prior Publication Data

US 2006/0242777 A1 Nov. 2, 2006

(30) Foreign Application Priority Data

Jul. 17, 2003 (NL) ..... 1023938

(51) Int. Cl.
*A47L 13/19* (2006.01)

(52) U.S. Cl. ..... 15/104.94; 15/227

(58) Field of Classification Search ..... 15/118, 15/227, 158, 104.94; 451/526, 523; 2/161.1, 2/160, 163
See application file for complete search history.

(56) References Cited

U.S. PATENT DOCUMENTS

| | | | | |
|---|---|---|---|---|
| 3,748,792 | A * | 7/1973 | Lamb | 451/523 |
| 4,038,787 | A * | 8/1977 | Bianchi | 451/523 |
| 5,010,617 | A * | 4/1991 | Nelson | 15/227 |
| 5,639,532 | A | 6/1997 | Wells | |
| 6,018,837 | A * | 2/2000 | Andreu | 15/118 |
| 6,192,543 | B1 * | 2/2001 | Lee | 15/118 |
| 6,241,580 | B1 * | 6/2001 | Fisher | 451/28 |
| 6,305,044 | B1 * | 10/2001 | James et al. | 15/227 |
| 6,494,767 | B2 * | 12/2002 | Fisher | 451/28 |
| 6,557,178 | B1 * | 5/2003 | Hoover | 2/161.6 |
| 6,811,338 | B1 * | 11/2004 | Gruenbacher et al. | 401/7 |
| 6,984,165 | B1 * | 1/2006 | Fisher | 451/36 |
| 2001/0036803 | A1 * | 11/2001 | Fisher | 451/523 |
| 2002/0170133 | A1 * | 11/2002 | McDevitt et al. | 15/167.1 |
| 2006/0242777 | A1 * | 11/2006 | Blokpoel | 15/104.94 |

FOREIGN PATENT DOCUMENTS

| | | |
|---|---|---|
| DE | 37 23 945 A1 | 2/1989 |
| FR | 2 632 511 | 12/1989 |

* cited by examiner

*Primary Examiner*—Lee D Wilson
(74) *Attorney, Agent, or Firm*—Pillsbury Winthrop Shaw Pittman LLP

(57) ABSTRACT

A polishing implement for polishing a shoe or the like, including a structure to be handheld provided with an absorbing fiber layer for forming a first polishing layer; and a sachet provided on or to be provided on the structure for containing the polishing product. According to the invention, the sachet includes a fiber layer impregnated with polishing product and, in closed condition, screened off by a protective layer while in opened condition, the impregnated fiber layer forms a second polishing layer for applying the polishing product to the shoe.

19 Claims, 3 Drawing Sheets

POLISHING IMPLEMENT FOR POLISHING SHOES

This application is the National Phase of PCT/NL2004/000508, filed Jul. 13, 2004, which claims priority to Netherlands application 1023938, filed Jul. 17, 2003, the entire contents of both applications being incorporated herein by reference in their entirities.

FIELD OF THE INVENTION

The invention relates to a polishing implement for polishing a shoe or the like, comprising a structure to be handheld, provided with an absorbing fibre layer for applying or introducing a polishing product; and a sachet attached to, or to be attached to the structure for containing the polishing product.

BACKGROUND OF THE INVENTION

Such an implement is known from the French patent FR-A-2,632,511. These and other like polishing implements have as a drawback that when they are utilised in practice, the polishing product is forced in an uncontrolled manner from a holder into and onto a fiber layer, so that initially, an excess of the product becomes available and the sachet empties prematurely.

BRIEF SUMMARY OF THE INVENTION

The object of the invention is to avoid this drawback and to provide an improved polishing implement, enabling a better application of the polishing product to the shoe.

This object is achieved with a polishing implement according to the features of claim 1. By providing the polishing implement with a sachet comprising a fiber layer impregnated with polishing product and which, in closed condition, is screened off by a protective layer, a well impregnated surface for applying the polishing product is provided immediately after the sachet is opened. In this manner, the ease of use can be enhanced in that, when in use, the polishing implement according to the invention immediately provides a polishing surface provided with polishing product. The polishing surface itself needs not first become impregnated before the polishing product is dispensed. Moreover, the polishing implement according to the invention offers the advantage that the polishing product has spread evenly over a relatively large surface the size of the dimension of the sachet, which is beneficial to the ease of use.

In one embodiment, the sachet can be removable and cover the first polishing layer at least partly, so that only after removal of the second polishing layer, the first polishing layer is completely revealed. This can be effected, for instance, by providing a weakly adhesive intermediate layer, or for instance through the use of Velcro tape.

In an alternative embodiment, the polishing implement can comprise an impermeable layer to which the such a is attached, which impermeable layer has a surface greater than the sachet. In particular, this impermeable layer can have a surface greater than the sachet in opened condition so that initially, upon introduction of the polishing product through the use of the second polishing layer, the first polishing layer remains protected and is only drawn on if all polishing product has been applied to the shoe by the second polishing layer.

In yet another alternative embodiment, in opened condition, the sachet reaches beyond an edge of the structure. As a result, this edge of the structure offers a good possibility for applying the polishing product accurately and with some force.

In a preferred embodiment, the sachet comprises a protective layer and, provided thereon, a fiber layer saturated with polishing product, while, in closed condition, the protective layer is folded over and sealed off along the edges, while the sachet is provided to the structure on one side of the fold. In particular, the sachet is then attached to a bottom side of the structure so that, in use, in folded opened condition, it reaches beyond the edge and is folded back, and can be attached to the top side of the structure. This offers, inter alia, the advantage that by folding over the fibre layer, impregnation is optimal, while further a relatively small surface of high quality, for instance vapour thigh (aluminum) foil can be used for closing it off. In use, this foil can contribute to the strengthening of the product adjacent the fingers.

In one elaboration, the structure comprises a glove. In a different elaboration, the structure comprises a handle and a relatively flat part forming a base for the sachet.

BRIEF SUMMARY OF THE DRAWINGS

The invention will be further elucidated with reference to the drawing. In the drawing.

DETAILED DESCRIPTION OF THE INVENTION

Figure 1:
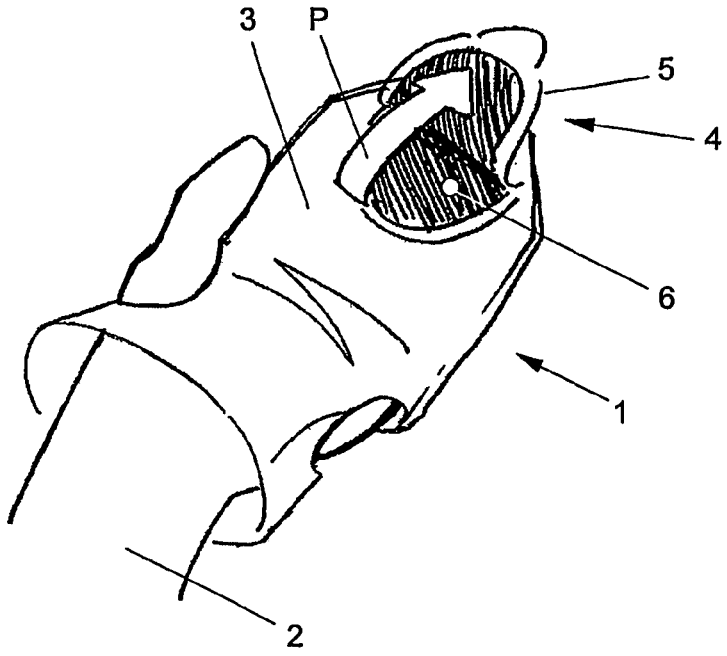
FIG. 1 shows a schematic representation of the polishing implement according to the invention in the form of a disposable glove.

In FIG. 1, a first embodiment of the polishing implement according to the invention is represented. In this Figure, a disposable glove 1 is illustrated from, for instance, a pressed non-woven material in which a hand 2 can be inserted. The non-woven material forms a first polishing layer 3, with which a shoe can be polished. On the material, a sachet 4 is attached which, in FIG. 1, is opened according to arrow P, as is further elucidated with reference to FIG. 2. The substantially flat sachet contains a polishing product such as shoe polish, cleaner or a treating agent. The sachet 4 further contains a protective layer 5 which is provided on the inside with a fiber layer 6 impregnated with polishing product, extending substantially to the edges of the protective foil 5. By folding the sachet open as shown in FIG. 1 and FIG. 2, the fiber layer 6 in opened condition can form a second polishing layer.

Figure 2:
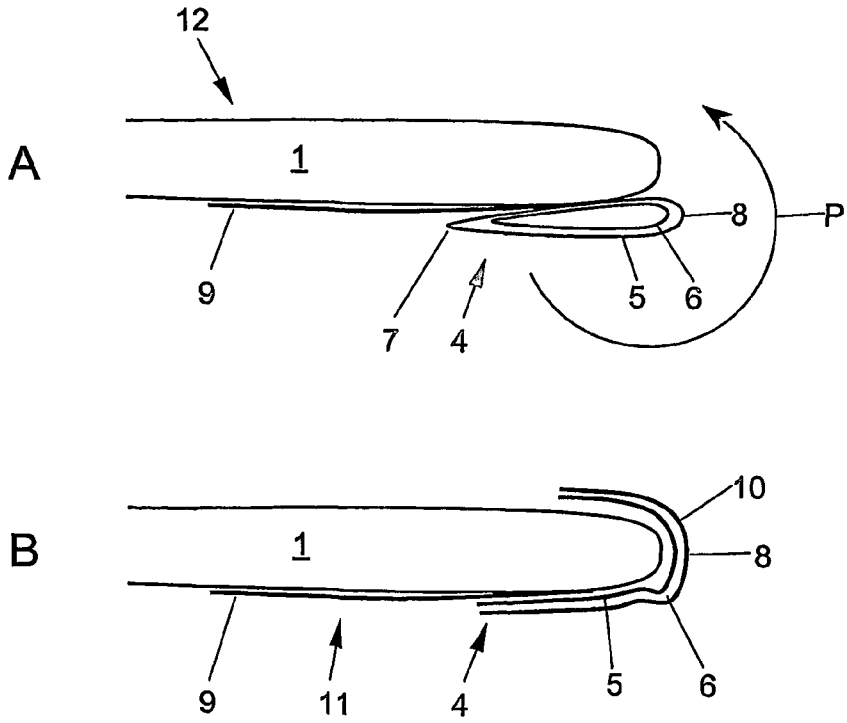
FIG. 2 shows a schematic representation of a cross section of the glove of FIG. 1, with the sachet in closed condition [A] and with the sachet in opened condition [B]

In sections [A] and [B], FIG. 2 shows the closed or opened condition, respectively, of the sachet 4, which has been attached adjacent the finger tips of a glove 1. In closed condition, the sachet 4 is folded over and sealed off along the edges 7, while the sachet is provided onto the structure on one side of the fold 8, for instance through thermal or acoustic welding or through gluing. Preferably, the sachet 4 consists of a high quality protective foil so that the shelf life of the impregnated material increases as the polishing product is prevented from degassing. As represented in FIGS. 2[A] and [B], preferably, the sachet is not attached to the glove 1 directly, but via an impermeable intermediate layer 9. This layer serves for enlarging the polishing surface of the second polishing layer 6, so that initially, the first polishing layer 3 remains protected, and is only drawn on if all polishing product has been applied to the shoe with the second polishing layer 6. The sachet 4 can for instance be glued to this impermeable layer 9. The impermeable layer can be removably provided on the glove 1, for instance with a weak adhesive glue or with Velcro tape or the like.

Preferably, the glove 1 in FIGS. 1 and 2 is formed such that in opened condition, the sachet reaches beyond the edge 10 which is formed, in use, by the extremity of the fingers. As a result, the polishing-ease for the user is enhanced and an object to be treated such as a shoe or the like can be treated more accurately. In particular, the sachet 4 is then attached to a bottom side 11, i.e. the inside of the hand of the glove, so that in use, in folded open condition, it reaches beyond the edge 10 and, when folded back, it can be attached onto a top side 12, i.e. the outside of the hand of the glove, for instance with Velcro tape (not shown), an adhesive strip or the like.

Figure 3:
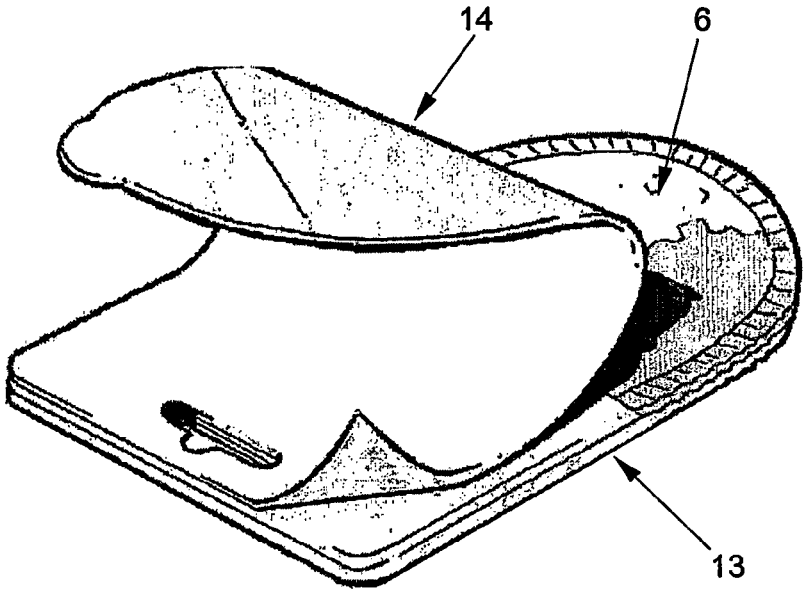
FIG. 3 shows another embodiment of the polishing implement according to the invention.
Figure 4:
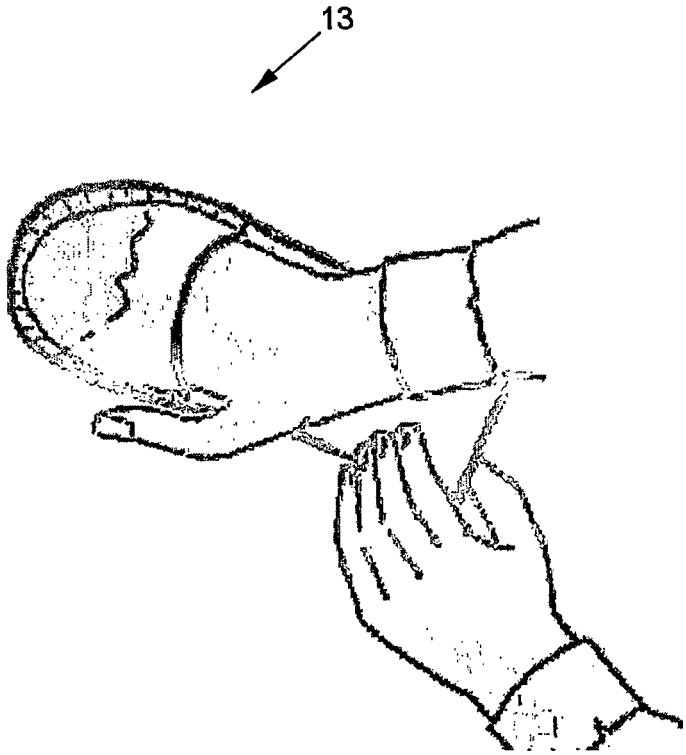
FIG. 4 shows the polishing implement of FIG. 3 in use.

FIG. 3 and FIG. 4 show a second embodiment of a disposable glove, modified according to the invention. In this embodiment, the glove 13 is relatively small and suitable to be pulled over only (a part of) the fingers, as shown in FIG. 4. A protective foil 14 has been provided over one side of the glove 13, so that upon removal thereof, as illustrated in FIG. 3, it reveals an impregnated fiber layer 6 forming a polishing layer for applying polishing product onto the shoe.

Figure 5:
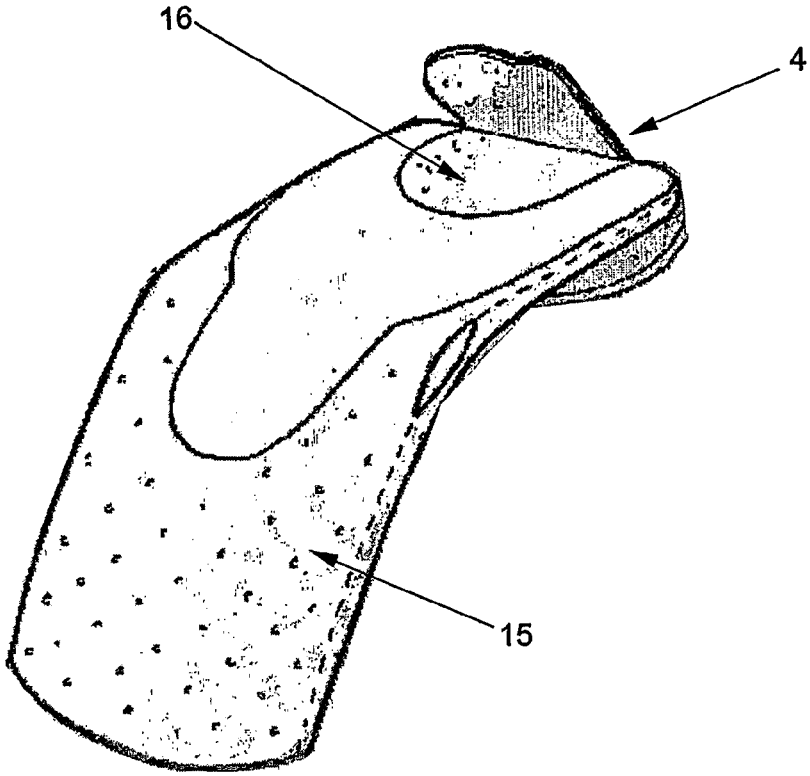
FIG. 5 shows a third embodiment of the polishing implement according to the invention.

FIG. 5 shows a variant: here, use is made of a sachet 4 which can be attached to a glove 15 while the glove needs not be thrown away. By means of a special fastening edge 16, the sachet is removably attached to the glove. The sachets are separate from the glove, included, for instance, in a special holder while during polishing, each time, a sachet can be taken from the holder and be attached to the glove 13.

Figure 6:
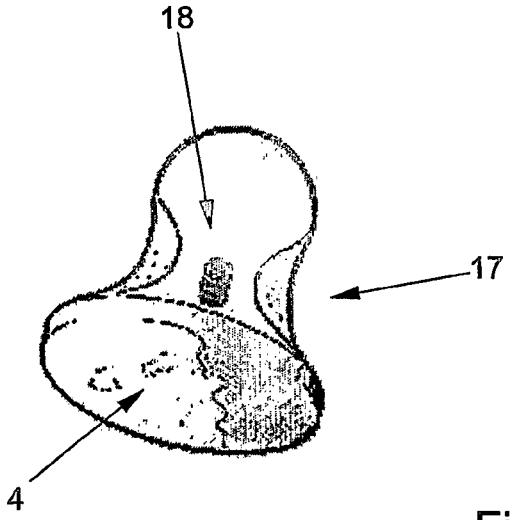
FIG. 6 shows a fourth embodiment of the polishing implement according to the invention.

FIG. 6 finally shows yet another embodiment, wherein the sachet 4 is attached to a special grip 17. With it, a handle 18 is provided to which the sachet can be attached in order to be used as a polishing implement. In a manner similar to that described hereinabove, the sachet 4 is provided with an impregnated fiber layer, which, in closed condition, is screened off by a protective layer and which, in opened condition, forms a polishing layer for applying the polishing product to the shoe.

The invention is discussed with reference to the embodiments, but various modifications and variations can be used. The structure can be manufactured from known laminated materials, wile use can be made of non-permeable layers on the inside and absorbing, for instance non-woven material on the outside. Also other materials with a surface structure suitable for roughening or performing other operations to shoes can be used (locally). Such variations are understood to fall within the framework of the invention as defined in the following claims.

The invention claimed is:

1. A polishing implement for polishing a shoe comprising:

a structure to be handheld, provided with an absorbing fiber layer for forming a first polishing layer; and a removable foldable sachet provided on or to be provided on a bottom side of the structure that covers the first polishing layer at least partly, so that only after removal of the sachet from the structure, the first polishing layer is completely revealed, the sachet comprising:

a fiber layer impregnated with a polishing product forming a second polishing layer; and a protective layer;

wherein, when the sachet is in a closed condition, a first portion of the second polishing layer faces a second portion of the second polishing layer, and the protective lever conceals the second polishing layer, and wherein when the sachet is in an opened condition, the protective layer of the sachet is folded back such that the sachet extends about an edge of the structure and a portion thereof attaches to a top side of the structure, and the first and second portions of the second polishing layer are exposed for applying the polishing product to the shoe.

2. A polishing implement according to claim 1, wherein the polishing implement comprises an impermeable layer to which the sachet is attached to the structure, the impermeable layer having a surface greater than the sachet.

3. A polishing implement according to claim 1, wherein while in the closed condition, the protective layer is sealed off along its edges.

4. A polishing implement according to claim 1, wherein the structure comprises a glove.

5. A polishing implement according to claim 1, wherein the structure comprises a handle and a relatively flat part forming a base for the sachet.

6. A polishing implement according to claim 1, wherein the portion of the sachet attaches to the top side of the structure by a removable fastener.

7. A polishing implement according to claim 6, wherein the removable fastener is one of a hook and fastener or an adhesive.

8. A polishing implement according to claim 1, wherein one of the first and second portions of the second polishing layer is formed on an underside of the protective layer.

9. A foldable sachet for a polishing implement comprising:

a fiber layer impregnated with a polishing product forming a polishing layer;

a protective layer; and a portion of the sachet comprising a removable fastener configured to attach the sachet to a structure;

wherein, when the sachet is in a closed condition, a first portion of the polishing layer faces a second portion of the polishing layer, and the protective layer conceals the polishing layer, and wherein when the sachet is in an opened condition, the protective layer is folded back such that the first and second portions of the polishing layer are exposed for applying the polishing product to the shoe.

10. A foldable sachet for a polishing implement according to claim 9, further comprising a grip.

11. A foldable sachet for a polishing implement according to claim 9, wherein one of the first and second portions of the polishing layer is formed on an underside of the protective layer.

12. A foldable sachet for a polishing implement according to claim 9, further comprising an impermeable layer to which the sachet is configured to attach to the structure.

13. A polishing implement for polishing a shoe, comprising:

a structure to be handheld, provided with an absorbing fiber layer for forming a first polishing layer; and a foldable sachet provided on or to be provided on a bottom side of the structure, the sachet comprising:

a fiber layer impregnated with a polishing product forming a second polishing layer; and a protective layer;

wherein, when the sachet is in a closed condition, a first portion of the second polishing layer faces a second portion of the second polishing layer, and the protective layer conceals the second polishing layer, and wherein when the sachet is in an opened condition, the protective layer is folded back such that the sachet extends about an edge of the structure and a portion thereof attaches to a top side of the structure, and the first and second portions of the second polishing layer are exposed for applying the polishing product to the shoe.

14. A polishing implement according to claim 13, wherein the sachet is removable and covers the first polishing layer at least partly, so that only after removal of the sachet, the first polishing layer is completely revealed.

15. A polishing implement according to claim 13, wherein the polishing implement comprises an impermeable layer to which the sachet is attached to the structure, the impermeable layer having a surface greater than the sachet.

16. A polishing implement according to claim 13, wherein while in the closed condition, the protective layer is sealed off along its edges.

17. A polishing implement according to claim 13, wherein the structure comprises a glove.

18. A polishing implement according to claim 13, wherein the structure comprises a handle and a relatively flat part forming a base for the sachet.

19. A polishing implement according to claim 13, wherein one of the first and second portions of the second polishing layer is formed on an underside of the protective layer.

* * * * *

UNITED STATES PATENT AND TRADEMARK OFFICE

CERTIFICATE OF CORRECTION

PATENT NO. : 7,636,978 B2
APPLICATION NO. : 10/564730
DATED : December 29, 2009
INVENTOR(S) : Blokpoel It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 445 days.

Signed and Sealed this
Fifteenth Day of February, 2011

David J. Kappos

David J. Kappos
*Director of the United States Patent and Trademark Office*